US008579107B2

(12) United States Patent
Egued

(10) Patent No.: US 8,579,107 B2
(45) Date of Patent: Nov. 12, 2013

(54) SLOW HUMECTATION CONTAINER

(76) Inventor: Nelson Alfonso Egued, Madrid (ES)

( * ) Notice: Subject to any disclaimer, the term of this patent is extended or adjusted under 35 U.S.C. 154(b) by 201 days.

(21) Appl. No.: 13/204,099

(22) Filed: Aug. 5, 2011

(65) Prior Publication Data

US 2012/0031779 A1 Feb. 9, 2012

(30) Foreign Application Priority Data

Aug. 6, 2010 (ES) ..... 201001043

(51) Int. Cl.
*A24F 25/00* (2006.01)

(52) U.S. Cl.
USPC ..... 206/213.1; 206/265; 312/31.1; 312/31

(58) Field of Classification Search
USPC ..... 206/242, 204, 213.1, 256, 205, 236; 131/303; 312/31, 31.1, 31.3
See application file for complete search history.

(56) References Cited

U.S. PATENT DOCUMENTS

| | | | | | |
|---|---|---|---|---|---|
| 2,680,048 | A | * | 6/1954 | McDonald | 312/31.1 |
| 3,135,565 | A | * | 6/1964 | Bingham | 312/31 |
| 3,336,093 | A | * | 8/1967 | Phelps | 312/31.1 |
| 3,801,011 | A | * | 4/1974 | Guehler et al. | 239/34 |
| 5,556,579 | A | * | 9/1996 | Newman | 261/99 |
| 5,687,749 | A | * | 11/1997 | Brauer, Jr. | 131/329 |
| D391,670 | S | * | 3/1998 | Hargrove | D27/189 |
| 5,893,454 | A | * | 4/1999 | Hermanek | 206/255 |
| 5,901,710 | A | * | 5/1999 | Barber | 131/274 |
| 5,957,277 | A | * | 9/1999 | Elliott | 206/205 |
| 6,006,903 | A | * | 12/1999 | Milone | 206/204 |
| 6,068,113 | A | * | 5/2000 | Schmaling et al. | 206/213.1 |
| 6,092,533 | A | * | 7/2000 | Moses | 131/329 |
| 6,112,889 | A | * | 9/2000 | Wicker | 206/213.1 |
| 6,298,857 | B1 | * | 10/2001 | Schmidt | 131/250 |
| 6,651,809 | B2 | * | 11/2003 | Holler | 206/213.1 |
| 2003/0029744 | A1 | * | 2/2003 | Holler | 206/256 |
| 2012/0031780 | A1 | * | 2/2012 | Milner et al. | 206/205 |

* cited by examiner

*Primary Examiner* — Steven A. Reynolds
(74) *Attorney, Agent, or Firm* — B. Aaron Schulman; Stites & Harbison, PLLC

(57) ABSTRACT

Slow humectation can features the use of humidifying materials inside it that allow the humectation of cigars and also the restoring of dried ones, it also has a shape in it lower side used to stack them, thus making them easier to transport or storage.

1 Claim, 4 Drawing Sheets

SLOW HUMECTATION CONTAINER

FIELD OF THE INVENTION

This invention has an application in the auxiliary tobacco industry and as an accessory for smokers.

BACKGROUND OF THE INVENTION

The current specification refers to an invention patent relative to a slow humectation can that allows a constant and uninterrupted humidifying process to cigars (it can be made of plastic, tin, etc) that can be stashed away no less than 5 months to avoid drying. This invention also works as a restoring for dried-up cigars without the need of a humidor, at the same time the cans can be stacked vertically in groups, thanks to a joining system between them; in the bottom of the cans there is a groove that occupies the space of the top lid of the can beneath it, this can be used for safe transport or stored easily avoiding any fall.

Cigars also known as "puros" or "habanos" in regard to their ancestral origin, is tobacco leaves rolled on itself and without any covering with paper. Its main origin is Cuba, with its soil and special weather condition of temperature and humid environment.

The consumption of cigars requires special conditions that allow them to enjoy its organoleptic features, specially its aroma and also to smoke them without efforts or inconvenience.

However the exporting of cigars to different latitudes other than their natural home an also with different temperatures and humidity conditions require the proper conservation of them, during its transportation and on the retail store and prior to been acquired by the smoker, or with him.

In the case of the retail stores, they generally have big humidors consisting of rooms or furniture that offer special conditions of humidity and temperature.

However for the consumers it's not practical to have these places that are of industrial use and high cost so the conservation of cigars requires the use of box type humidors, that consist of wooden boxes with a humidifying system, mainly a humid sponge, helping in the conditions needed for the cigar to be ready for smoking. The system requires periodic moistening of the sponge.

According to the invention, it consists of a humidifying device for small size cigars, made of a can with a lid on its upper side. Inside there is the humectation material made of two humid sponges, one placed inside the upper lid and the other on the bottom of the can respectively, the lid has small holes in the lower side so as to let out humidity from the sponge. At the same time in the bottom of the can it has a cavity to allow the stacking of another can, to be used as a joining system that makes a perfect match for transportation or storage.

The optimal conditions for a cigar to be fresh it's a temperature between 18 and 22 degrees centigrade and a humidity of around 65 to 75%.

The slow humectation can stands for the easy humectation of cigars, so they can be kept with the proper temperature and humidity below the allowed range. In order to maintain these conditions, the only thing necessary is to keep the sponge wet.

The slow humectation can proposed in this invention, it's an clear solution to provide an adequate humectation to cigars or "puros", in a uniform and slow way through cedar plates.

At the same time it allows a easier transportation or storage due to the design in the bottom of the can and on its top lid providing a perfect match.

SUMMARY OF THE INVENTION

The present application seeks to provide a slow humectation container used to preserve the adequate humidity for cigars or the restoring of dried ones, formed by top lid of the can (1) with the following elements: a handle or grip (1A); fastening notches; upper part of the lid (1C), lower part of the lid (1D); holes for humidity to pass through (1E); humectation sponges (2A) and (2B); cedar plates (3A) and (3B) and a body of the can (5A) and bottom of the can that has a semi-spherical cavity (5B) to allow the proper stacking of cans one on top of the other making a perfect match.

BRIEF DESCRIPTIONS OF THE DRAWINGS

As a complement to the description that is been made and with the object of a better understanding of the highlights found In this invention, a set of 4 diagrams is shown, by way of illustrations and not limitation the following has been represented:

DETAILED DESCRIPTION OF THE INVENTION

Figure 1:
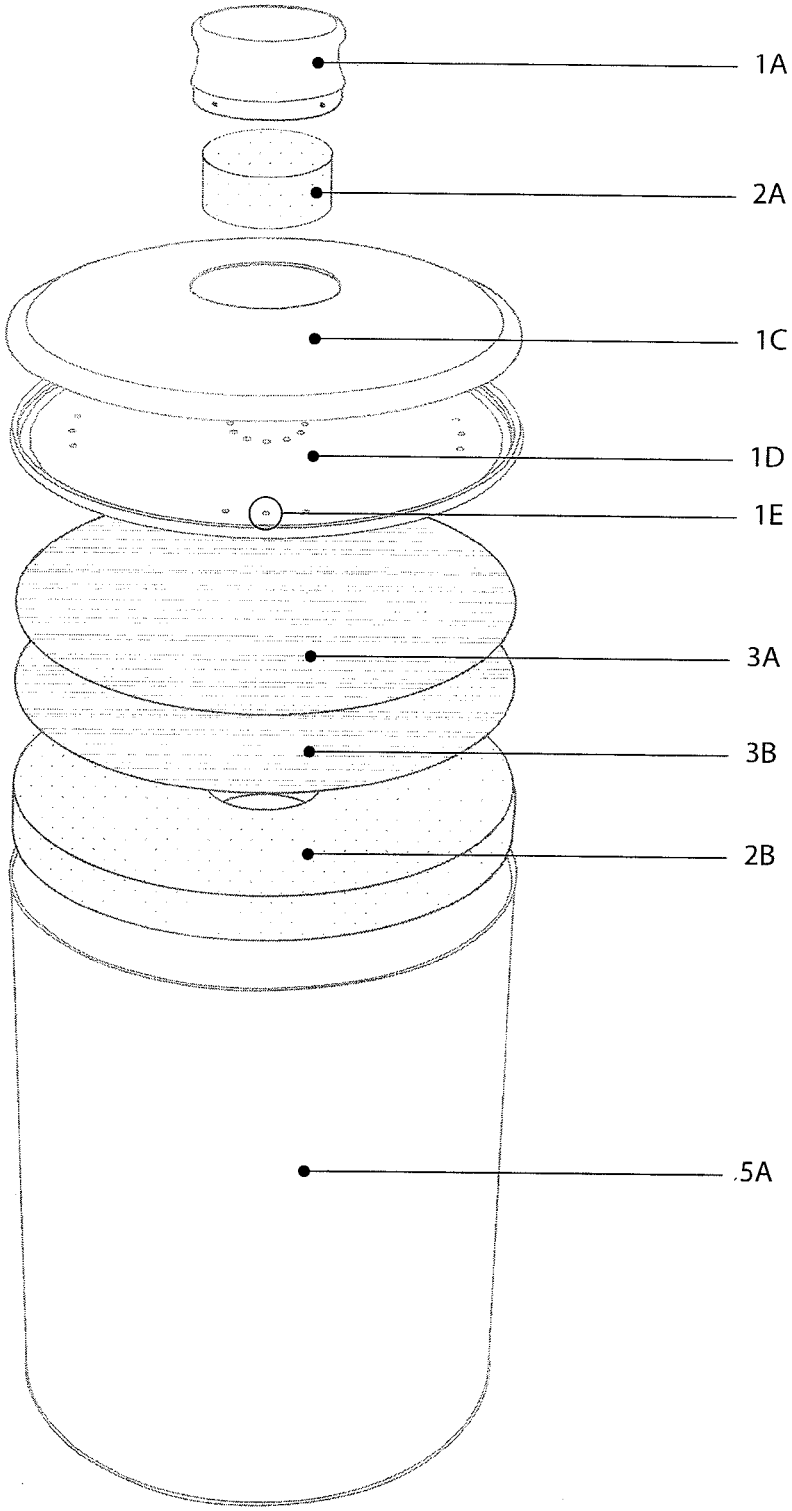
FIG. 1 shows an axonometric view of all the elements of the can.
Figure 2:
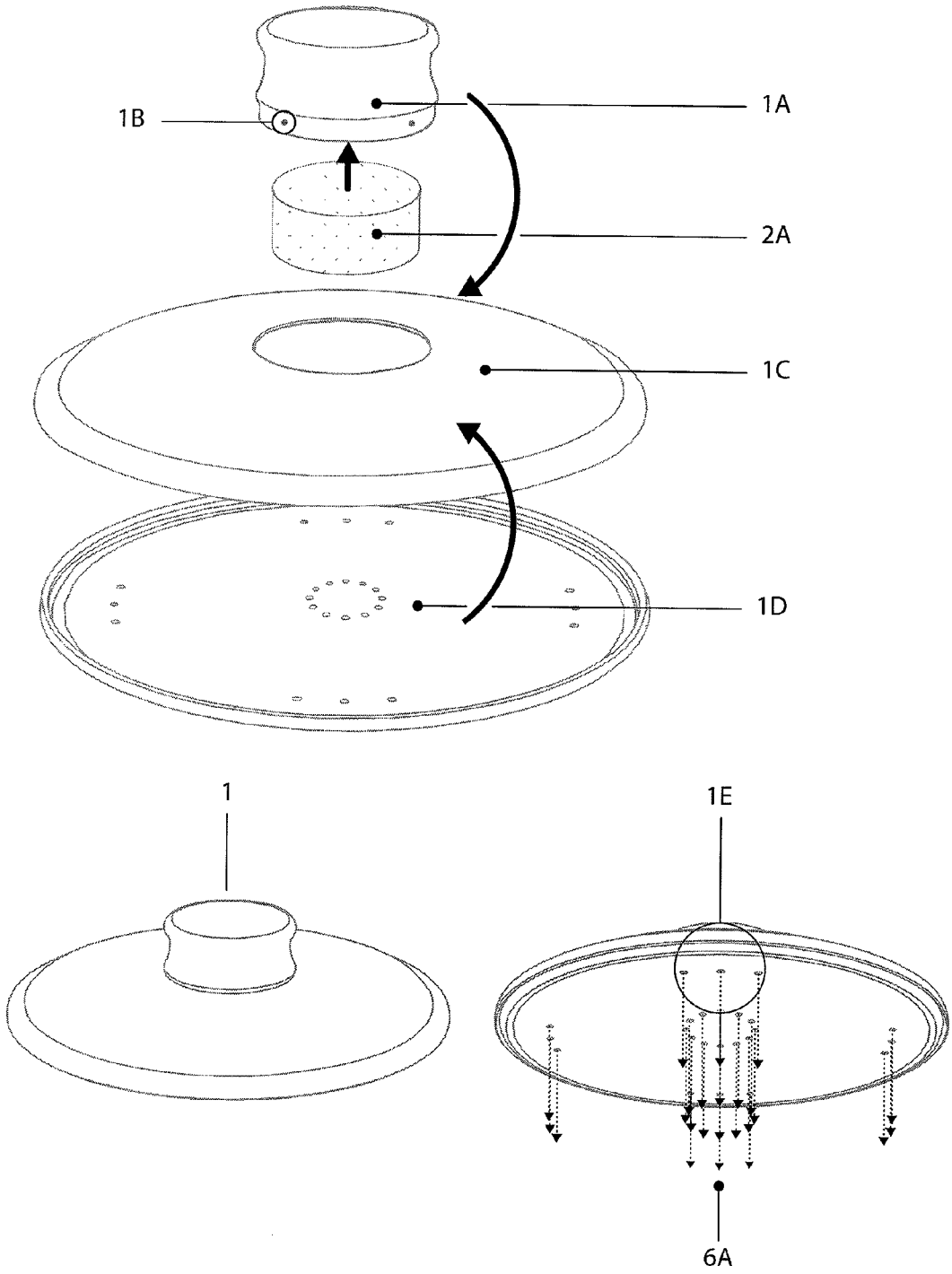
FIG. 2 shows a axonometric view with the details regarding the top lid of the can and also the direction of flow of humidity through the holes in it.
Figure 3:
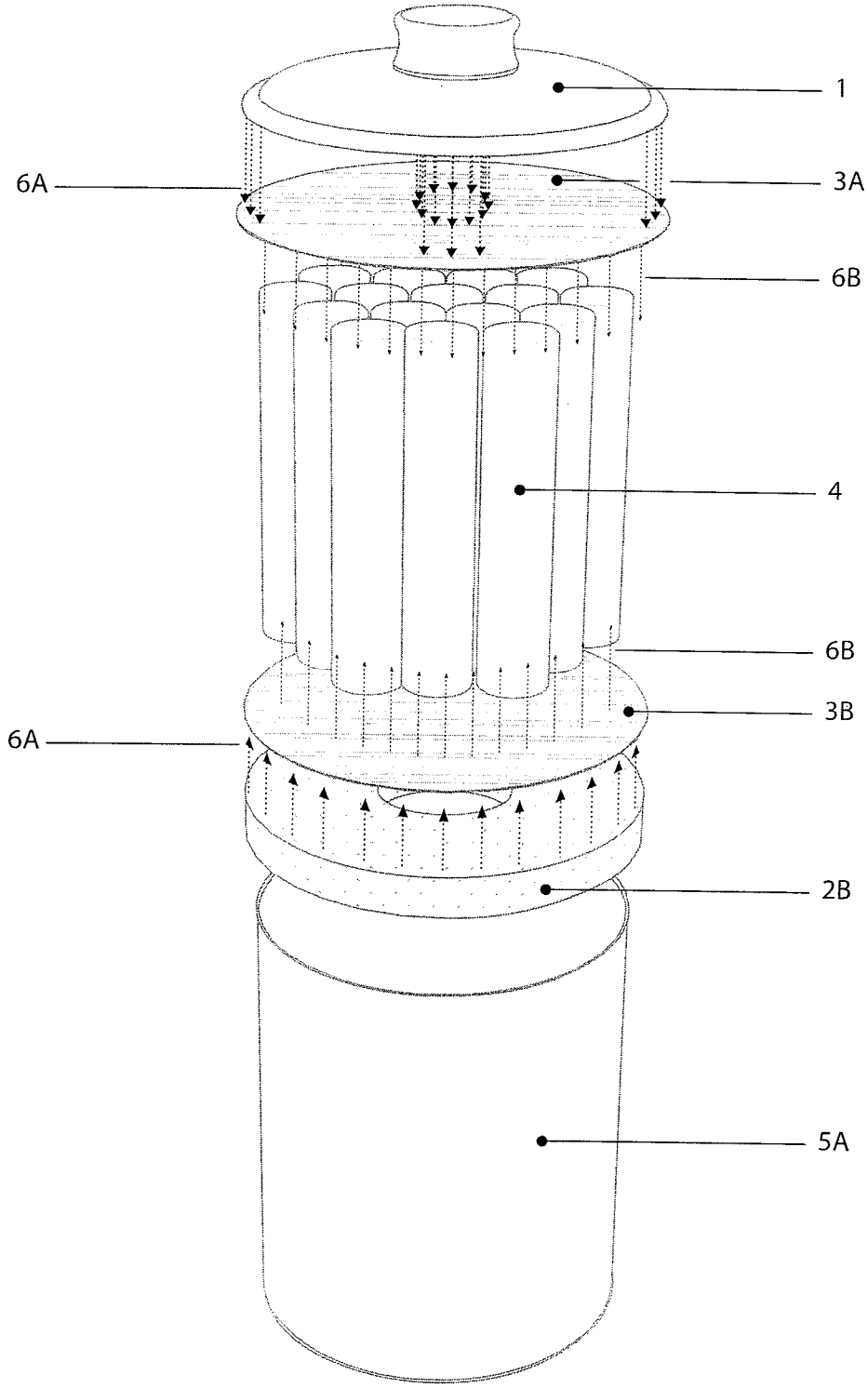
FIG. 3 shows an axonometric view of the final configuration of the object, in which all the elements of the can are observed including the "puros", the flow of humidity is also seen from the humectation sources.

As it can be seen from the drawings, in the inside of the handle or grip (1A) is where the wet sponge (2A) is located and the grip is joined with the upper side of the lid using small fastening notches (1B) that make a strong hold, but it can be removed easily if you wish. The upper side of the lid (1C) will be joined in a permanent way with the lower side (1D) using a fastening system. The lower side of the lid (1D) has small holes (1E) in charge of letting humidity go through (6A) that is stored inside the cavity made from the lower side (1D) and the upper part (1C).

Figure 4:
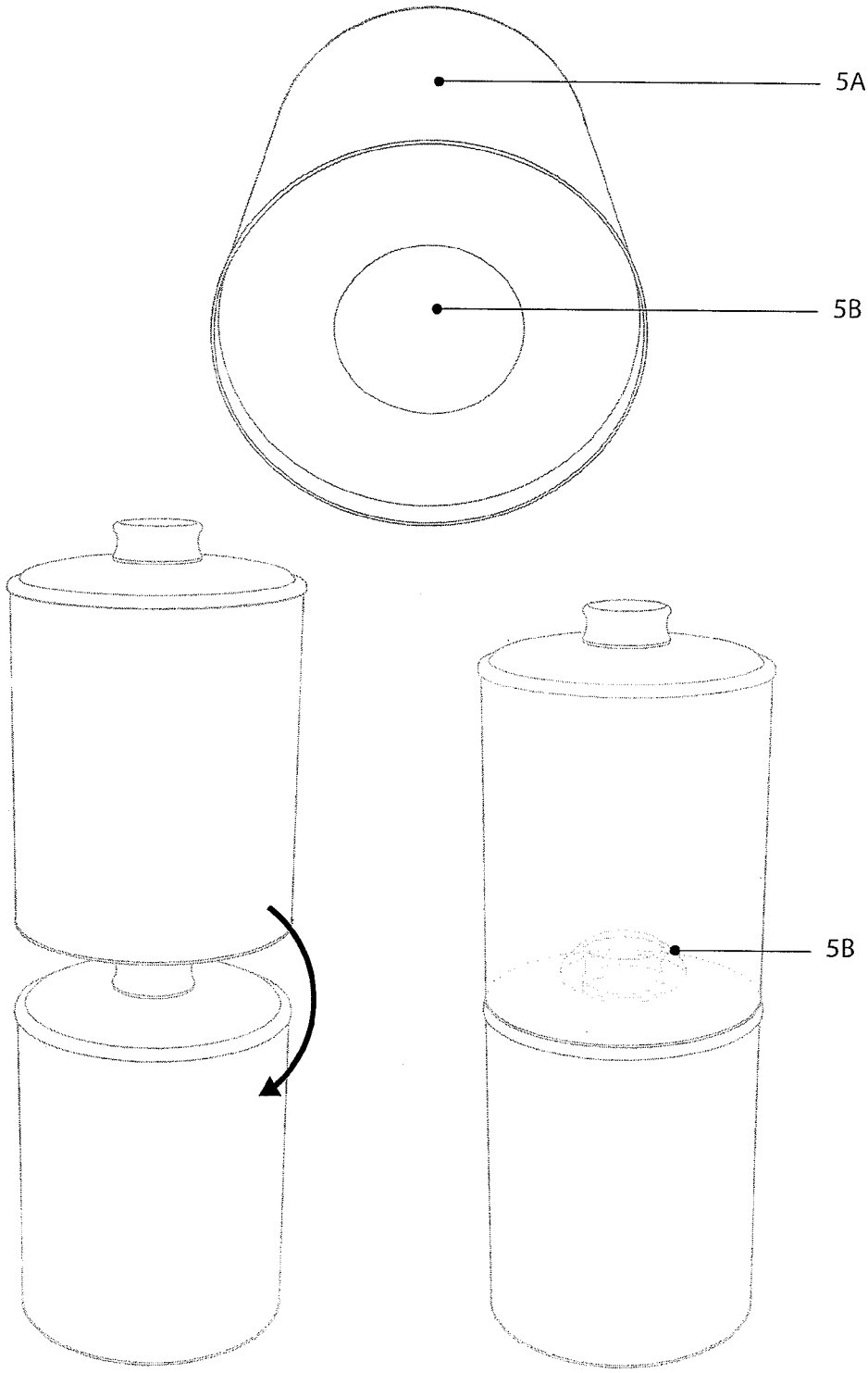
FIG. 4 shows a three-dimensional view of the whole can with the details of the bottom of the can and the stacking procedure.

On the inside of the body of the can (5A) the second wet sponge (2B) is located. The cigars (4) are contained inside the can and above and below them, just bellow the lower side of the lid (1) and above the second wet sponge (2B) cedar plates (3A) and (3B) to avoid cigars coming contact with humidity (6A). The cedar plates help reduce the amount of humidity (6A) accumulated and only allow a small amount (6B) to pass through to the cigars (4). At the same time and as filtering device they provide fragrance. The semi-spherical cavity (5B) of the body of the can allows the stacking of cans one on top of the other making a perfect match (FIG. 4).

Finally and taking in consideration the slow humectation of the device, dry cigars can be restored due to improper storage, the system provides that when you put the dried cigar inside the can, it absorbs the humidity from the sponges to a desired level of humidity. In other words, the cigars act as a slow absorbent of water contained in the sponges.

The following tables show data regarding maintenance and restoring of "puros" by means of a slow humectation can, shown in this invention.

TABLE 1

Maintenance of a "puro" according to its weight (in grams)

| | Puro from 4 to 10 grs | Puro from 10 to 16 grs | Puro from 16 to 20 grs |
|---|---|---|---|
| Sponge Moistened 100% | 8 months | 6.5 months | 5 months |
| Sponge Moistened 50% | 5 months | 3.5 months | 2 months |

TABLE 2

Restoring of a "puro" according to its weight (in grams)
The "puro" is introduced in the can totally dried (bad)

| | Puro from 4 to 10 grs | Puro from 10 to 16 grs | Puro from 16 to 20 grs |
|---|---|---|---|
| Sponge Moistened 100% | 5 months | 2.5 months | 2 months |
| Sponge Moistened 50% | 2.5 months | 1 month | Less than a month |

PREFERRED MAKING OF THE INVENTION

Example 1

The slow humectation can, according to the description given has two sections, the upper and formed by its top lid (1) and the bottom one formed by the body of the can (5A).

Before introducing the cigars(4) proceed to pull the handle or grip(1A) from the upper part of the lid (1C) and moisten the sponge (2A) inside, next step put back with pressure the grip (1A) in the upper part of the lid (1C).

After it is proceeded to moderately moisten the sponge (2B) contained in the bottom of the can (5A), once its wet it is returned to its place, one cedar plate (3B) is then placed, the cigars(4) are put inside the can, above them one cedar plate (3A) and the device is closed joining the top lid (1) with the body of the can (5A).

Once the can is closed, the humidity (6A) coming from the moistened sponges (2A) and (2B) accumulates in the inside and in the bottom of the can, the use of cedar plates (3A) and (3B) reduces the volume and concentration of humidity.

If several cans are available, while they humidify, they are placed on top of each other preferably at a height of 5 cans, by placing the bottom of the can (5B) over the top lid of the other.

The slow humectation can is not only employed for the preservation of cigars(4) with the correct humidity, it can also be used to restore those cigars that are dried because an improper storage was used.

The system works in a way that when the dried cigars (4) are placed inside the cavity (5A), they absorb the moisture from the sponges and through the cedar plates (3A) and (3B) slowing down the humidity to the "puros" until the required magnitude of humidity is achieved. In other words works as an absorbent through the two cedar plates and from the water that contained in both sponges (2A and 2B).

The invention claimed is:

1. A slow humectation can used to preserve adequate humidity for cigars or the restoring of dried cigars, comprising:

(a) a top lid of the can, being formed by the following elements:
  (a1) a handle or grip;
  (a2) fastening notches;
  (a3) an upper part of the lid;
  (a4) a lower part of the lid;
  (a5) holes for the humidity to go through;
(b) humectation sponges;
(c) cedar plates, and
(d) a body of the can, wherein the body of the can has a semi-spherical cavity to allow the proper stacking of cans;

wherein, the handle or grip in the lid of the can contains one of the humectation sponges, wherein the handle or grips joined to the top lid using the fastening notches;

wherein the lid of the can has a cavity formed between the upper part of the lid and the lower part of the lid;

wherein the holes pass through the lower part of the lid for humidity, that accumulates inside the cavity, to pass through;

and wherein one of the humectation sponges is located within the body of the can, providing space for the cedar plates to be used for regulation and filtering of humidity.

* * * * *